United States Patent [19]

Ritzmann

[11] 4,105,396

[45] Aug. 8, 1978

[54] APPARATUS FOR HEAT TREATMENT OF FINE GRAINED MATERIALS

[75] Inventor: Horst Ritzmann, Enniger, Fed. Rep. of Germany

[73] Assignee: Polysius AG, Neubeckum, Fed. Rep. of Germany

[21] Appl. No.: 755,233

[22] Filed: Dec. 29, 1976

[30] Foreign Application Priority Data

Jan. 27, 1976 [DE] Fed. Rep. of Germany ..... 2602889

[51] Int. Cl.[2] ..... F27B 15/00; F27B 7/02

[52] U.S. Cl. ..... 432/14; 432/106

[58] Field of Search ..... 432/14, 15, 58, 106

[56] References Cited

U.S. PATENT DOCUMENTS

| | | | |
|---|---|---|---|
| 2,351,677 | 6/1944 | Gygi | 432/106 |
| 3,712,600 | 1/1973 | Landthaler | 432/106 |
| 4,039,277 | 8/1977 | Kobayashi et al. | 432/106 |

*Primary Examiner*—John J. Camby

*Attorney, Agent, or Firm*—Jones, Thomas & Askew

[57] ABSTRACT

This invention relates to a device for the heat treatment of fine material, including a rotary tube furnace, a multi-stage pre-heater heated by the exhaust gases from the rotary furnace and a zone through which the exhaust gases flow and provided with rotary lifting members, with the material extracted from the second stage of the pre-heater being fed into said zone before it is fed from the furnace exhaust gases from the first stage of the pre-heater and then reaches the rotary tube furnace.

5 Claims, 1 Drawing Figure

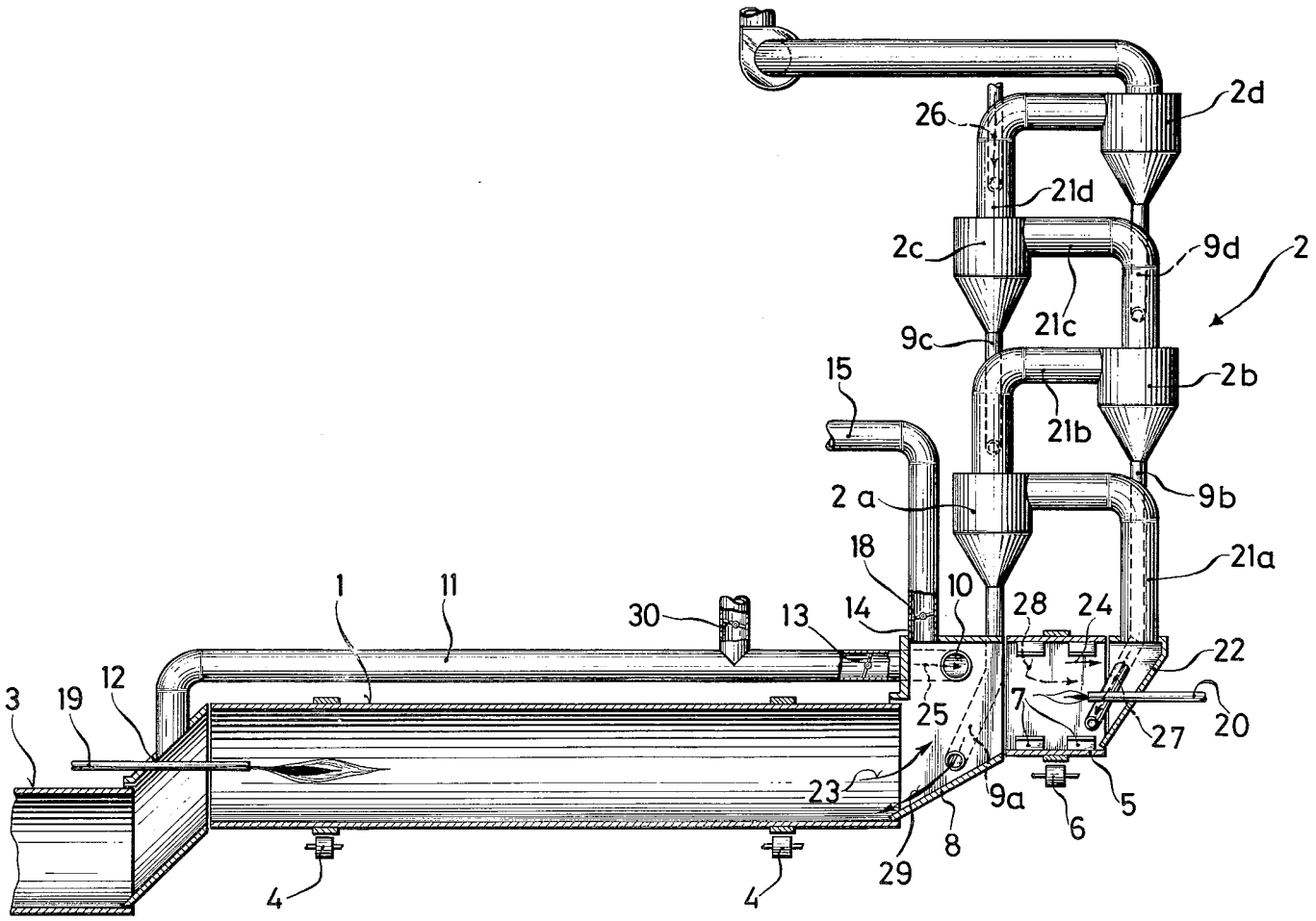
2
2d
9d
2b
9b
21a
22
20
27
5
6
24
28
7
9a
8
29
21d
21c
21b
26
2c
9c
10
25
2 a
18
14
15
13
23
4
30
11
1
4
12
19
3

APPARATUS FOR HEAT TREATMENT OF FINE GRAINED MATERIALS

BACKGROUND OF THE INVENTION

In the known rotary tube furnace plants, the zone through which the exhaust gases pass and which is provided with rotary lifting members comprises a ring disposed adjacent the material inlet end of the furnace which rotates jointly with the furnace. The material extracted from the second stage (i.e., the second from the bottom) of the cyclone pre-heater is fed into this ring. As this ring, which forms a component of the rotary tube furnace, is rotating, this material is fed into the exhaust gases passing through the ring. The material together with the furnace exhaust gases then passes into the first (lowermost) stage of the cyclone pre-heater, whence after separation it is fed into the rotary tube furnace.

While such a construction does allow the length of the rotary furnace to be reduced in comparison with other known constructions (not having the ring described), it does on the other end have considerable disadvantages.

Because of the reduced length of the furnace, the exhaust gases in the vicinity of the said ring or material inlet are still at relatively high temperature. This high gas temperature, which is dangerous for the following parts of the plant, especially for pipes and chutes of narrow cross-section, is during normal operation of course brought down to a sufficiently low value by the material fed through the ring into the gas stream. But if for any reason during operation the feed of material briefly drops, temperatures at the inlet zone of the furnace rise rapidly and lead to dangerous overheating. If the supply is then restored a little later, unwanted accumulations often occur on the walls of gas pipes, especially in the transition area between pre-heater and rotary furnace.

SUMMARY OF THE INVENTION

The invention is based on the problem of avoiding these defects of the known construction in providing a device of the type concerned which, while still permitting use of a shorter rotary tube furnace length, will preclude the risk of accumulations in parts of the plant following the rotary furnace, especially in the transition area between pre-heater and rotary furnace, if there is an unexpected reduction in material supply.

According to the invention this problem is solved in that the zone provided with rotary lifting members comprises a rotary drum having its own drive and separated from the rotary tube furnace by a fixed inlet housing.

Because of the separate rotary drive for the drum, such a construction naturally involves some extra expense as compared with the initially described device wherein the said zone provided with rotary lifting elements comprised a ring rotating with the furnace. But on the other hand the device in accordance with the invention provides important technical benefits which far outweigh the slight extra cost.

Thus the fixed inlet housing between the rotary drum with the lifting members and the rotary furnace permits the connection at that point of a pipe for supplying cooler exhaust air and/or a by-pass pipe for removing furnace exhaust gases while avoiding the pre-heater.

Each of these measures is effective in preventing operational upsets due to overheating in the furnace inlet zone if the supply of material fails. When there is this unexpected drop in the supply of material from the pre-heater to the rotary drum for instance a large proportion of the furnace exhaust gases is immediately removed via the by-pass pipe, hence avoiding a dangerous temperature rise, especially in the parts of the plant between the pre-heater and the rotary furnace. The same effect can be attained by increasing the amount of cooler exhaust air supplied to the inlet housing.

The use of a drum equipped with its own rotary drive has the further advantage that the drum can then be driven at a higher rotary speed than the rotary tube furnace. This is beneficial in enabling the material extracted from the second stage of the pre-heater to the taken into the furnace exhaust gas stream as quickly and uniformly as possible.

The construction provided by the invention also enables a further fuel feed to be provided adjacent the rotary drum with its lifting members, thus ensuring further pre-calcination of the material before entering the rotary furnace.

Thus further fuel feed can be succeeded by a burner which either projects into the rotary drum from the end remote from the inlet housing or is disposed at the side of the rotary furnace inlet housing (in the latter case the cooler exhaust air supply pipe and the by-pass pipe for removing furnace exhaust gases are preferably provided off-center on the inlet housing).

The additional fuel can however be added to the material extracted from the second stage of the pre-heater and mixed with that material before it is taken into the gas stream by the lifting members in the rotary drum. This last method largely provides combustion of the additional fuel on the individual particles of material, and hence optimum transfer of heat from fuel to material. In this case the fuel feed can for instance take place in the material outlet pipe from the second stage of the pre-heater or adjacent the inlet chute whereby the material extracted from the second stage of the pre-heater reaches the rotary drum.

The rotary tube furnace plant in accordance with the invention is therefore marked by the possibility of reducing the length of the furnace without having to undergo the risk of material accumulating in the parts of the plant subsequent to the furnace especially if the material supply briefly drops, and also permits operation with by-pass feed of the furnace exhaust gases and pre-calcination of any type.

DETAILED DESCRIPTION

One embodiment of the invention is shown in the drawing. The rotary tube furnace plant for the heat treatment of fine material, for example raw powdered cement, consists in general of a rotary tube furnace 1, a multi-stage cyclone pre-heater 2 and a cooler 3, merely indicated.

Between the furnace 1 rotating in normal manner on rollers 4 and the pre-heater 2 there is disposed a rotary drum 5 which runs on rollers 6 and is provided with a rotary drive separate from that for the furnace 1. The interior of this rotary drum 5 is fitted with lifting members 7.

Between the rotary tube furnace 1 and the rotary drum 5 is a fixed inlet housing 8 wherein terminates the material outlet pipe 9*a* from the first stage 2*a* of the multi-stage cyclone pre-heater 2.

The inlet housing 8 is also provided with an inlet terminal 10 for cooler exhaust air supplied via a pipe 11 from the intermediate housing 12 between the rotary furnace 1 and the cooler 3. A valve member 13 is provided in pipe 11.

The inlet housing 8 is also provided with a by-pass terminal 14 for removing furnace exhaust gases while by-passing the pre-heater 2. This pipe 15 leading to a dust extractor also contains a valve 18.

In the area of its material outlet end the rotary furnace 1 is provided in normal manner with a burner 19. In the embodiment shown, a further burner 20 is present in the vicinity of the rotary drum 5; it projects into the drum 5 from the side remote from the inlet housing 8.

The four stages 2a, 2b, 2c, 2d of the multi-stage cyclone pre-heater 2 are connected in normal manner to their gas conduits 21a–21d and their material outlet conduits 9a–9d. As already mentioned, the material outlet conduit 9a from the first stage 2a of pre-heater 2 terminates in the inlet housing 8, and the material outlet conduit 9b from the second stage 2b of the pre-heater terminates in the rotary drum 5. The mode of operation of the rotary tube furnance plant illustrated is as follows:

The exhaust gases from the rotary furnace (arrow 23) pass through the rotary drum 5 (arrow 24) and then in sequence through stages 2a, 2b, 2c and 2d of the cyclone pre-heater 2. In order to ensure combustion of the additional fuel fed through the burner 20, a certain amount of cooler exhaust air (arrow 25) can be introduced via pipe 11 into the inlet housing 8. This quantity of air may be such that complete combustion takes place, or may be reduced to provide only partial combustion. Full combustion can then be achieved by feeding air into the bottom portion of the pre-heater. In normal operation the valve 18 in the by-pass pipe 15 is usually closed.

The fine material supplied at 26 is first pre-heated in known manner in the stages 2d, 2c and 2b of the cyclone pre-heater 2 by the exhaust gases from the rotary tube furnace. The material extracted from the second stage of the cyclone pre-heater 2 passes via pipe 9b into the rotary drum 5 (arrow 27), wherein it is conveyed upwards by the lifting members 7 and introduced (arrow 28) into the gas stream (arrow 24).

The material then travels with the exhaust gases in the cyclone to the lowest stage 2a of the pre-heater 2 where it is separated and taken via the outlet pipe 9a into the inlet housing 8 of the rotary furnace 1 (arrow 29); the material then passes in known manner through rotary furnace 1 and cooler 3.

The additional fuel supplied from the burner 20 produces practically full calcination of the material before it reaches the furnace 1. Hence the furnace 1 can be made with a reduced length.

If for unforeseen reasons the supply of material to the rotary drum suddenly drops during operation, the valve 18 in the by-pass pipe 15, and the amount of cooler exhaust air fed to the inlet housing 8 is also increased, if necessary also by further opening of the valve 13. Where necessary, fresh air can also be supplied by opening a throttle valve 30. In this manner dangerous overheating is avoided, especially of the chute 22 and the gas pipe 21a leading to the lowermost stage 2a of the cyclone. Where the raw material conditions require, a certain amount of gas may be also constantly supplied via the by-pass pipe 14 to reduce the circulation of alkali, chlorine and sulphur.

While this invention has been described in detail with particular reference to preferred embodiments thereof, it will be understood that variations and modifications can be effected within the spirit and scope of the invention as described hereinbefore and as defined in the appended claims.

What is claimed is:

1. Apparatus for heat treating fine material comprising an open-ended rotary furnace including a burner at one of its ends, a fixed material inlet housing at the other end of said rotary furnace, a rotary drum adjacent said inlet housing and including material lifting members therein, first drive means for rotating said rotary furnace, second drive means for rotating said rotary drum, means for inducing a flow of gas in sequence through said furnace, said fixed material inlet housing and said rotary drum, and conduit means in communication at one of its ends with said rotary furnace upstream of said burner and in communication at its other end with said fixed material inlet housing, valve means in said conduit means for adjusting the flow of gas through said conduit means, whereby a portion of the flow of air from upstream of the burner to the fixed material inlet housing can by-pass the furnace by flowing through the conduit means to control the temperature in the rotary drum.

2. A device as in claim 1, and further including a by-pass terminal provided in said inlet housing for removing furnace exhaust gases from said inlet housing while by-passing the pre-heater.

3. Apparatus for heat treating fine material comprisng an open-ended rotary furnace including a burner at one end, a fixed material inlet housing at the other end of said rotary furnace, a rotary drum adjacent said inlet housing and including material lifting members therein, first drive means for rotating said rotary furnace, second drive means for rotating said rotary drum, a multi-stage pre-heater including a first material outlet in communication with said fixed material inlet housing for feeding pre-heated material to said housing and a second material outlet in communication with said rotary drum for feeding pre-heated material to said rotary drum, and conduit means for recirculating the material from said rotary drum to said multi-stage pre-heater for delivery to said fixed material inlet housing.

4. In a heat treatment system including an open ended rotary tube furnace, a fixed material inlet housing at one end of the furnace, a burner at the other end of the furnace, a rotary drum with material lifting members therein adjacent the inlet housing and a multi-stage material pre-heater including a first material outlet in communication with the fixed material inlet housing and a second material outlet in communication with the rotary drum, the method of heat treating fine material comprising the steps of inducing air to flow in sequence through the open ended rotary furnace, through the fixed material inlet housing, through the open ended rotary drum, and through the multi-stage material pre-heater, heating the air with the burner as it flows through the rotary furnace, rotating the rotary furnace, rotating the rotary drum at a higher rotary speed than the rotation of the rotary furnace, feeding fine material through the multi-stage pre-heater and through the first material outlet to the fixed material inlet housing and through the second material outlet to the rotary drum, and recirculating the material from the rotary drum back to the pre-heater for delivery to the fixed material inlet housing.

5. The method of heat treating fine material as claimed in claim 4 and further characterized by the step of heating the air and fine material in the rotary drum.

* * * * *